US012588754B2

(12) United States Patent
Meyer

(10) Patent No.: US 12,588,754 B2
(45) Date of Patent: Mar. 31, 2026

(54) KEYBOARD TRAY WITH SWINGING HEIGHT ADJUSTMENT

(71) Applicant: CKnapp Sales, Inc., Goodfield, IL (US)

(72) Inventor: Brandon Meyer, Normal, IL (US)

(73) Assignee: CKnapp Sales, Inc., Goodfield, IL (US)

( * ) Notice: Subject to any disclaimer, the term of this patent is extended or adjusted under 35 U.S.C. 154(b) by 111 days.

(21) Appl. No.: 18/206,611

(22) Filed: Jun. 6, 2023

(65) Prior Publication Data

US 2024/0407544 A1 Dec. 12, 2024

(51) Int. Cl.
*A47B 21/03* (2006.01)
*A47B 21/02* (2006.01)

(52) U.S. Cl.
CPC ..... *A47B 21/0314* (2013.01); *A47B 21/02* (2013.01); *A47B 2021/035* (2013.01); *A47B 2200/0085* (2013.01)

(58) Field of Classification Search
CPC ..... A47B 21/0314; A47B 21/02; A47B 2200/0085; A47B 2021/035
USPC ..... 108/96
See application file for complete search history.

(56) References Cited

U.S. PATENT DOCUMENTS 102,938 A 5/1870 Heminway et al.
213,775 A * 4/1879 Redman ..... F16M 11/04 248/281.11
1,050,672 A * 1/1913 Macintosh ..... F16M 11/04 248/281.11
1,139,581 A * 5/1915 Riley ..... F16M 11/04 433/79
1,824,822 A * 9/1931 Kradolfer ..... A47B 21/02 248/646
2,509,060 A * 5/1950 Hoder ..... B60N 3/002 108/166
2,671,910 A 3/1954 Frank
(Continued)

FOREIGN PATENT DOCUMENTS

CA 2671910 A1 12/2008
CN 208172737 U 11/2018
(Continued)

OTHER PUBLICATIONS

Black Clamp-on Keyboard Tray: Instruction Manual: SKU: MOUNT-KB05E; Aug. 25, 2021; 4 pages; VIVO; Goodfield, Illinois.
(Continued)

*Primary Examiner* — Daniel J Troy
*Assistant Examiner* — Timothy M Ayres
(74) *Attorney, Agent, or Firm* — Lund IP, PLLC

(57) ABSTRACT

An adjustable keyboard tray includes a swinging support, the swinging support including a desk mount configured to secure the adjustable keyboard tray to a desktop, a keyboard platform mount, and a linkage coupled to the desk mount with a first pivot and coupled to the keyboard platform mount with a second pivot. The adjustable keyboard tray further includes a keyboard platform attached to the keyboard platform mount, the keyboard platform being swingable relative to the desk mount via the linkage between a retracted position relative to the desk mount and an outward position relative to the desk mount.

25 Claims, 8 Drawing Sheets

(56) References Cited

U.S. PATENT DOCUMENTS

| | | | | | |
|---|---|---|---|---|---|
| 2,703,265 | A * | 3/1955 | Wolfe | A47B 23/02 | 5/503.1 |
| 3,220,592 | A | 11/1965 | Powell et al. | | |
| 3,865,336 | A | 2/1975 | Robertson | | |
| 4,350,098 | A * | 9/1982 | Shirono | H05K 7/18 | 248/242 |
| 4,625,657 | A | 12/1986 | Little et al. | | |
| 4,736,689 | A | 4/1988 | Stanko | | |
| 4,923,259 | A * | 5/1990 | Bartok | A47B 21/0314 | 108/143 |
| 4,988,066 | A * | 1/1991 | Cotterill | A47B 21/0314 | 108/6 |
| 5,005,669 | A * | 4/1991 | Umebara | A47F 9/046 | 248/397 |
| D318,390 | S | 7/1991 | Murray | | |
| 5,037,163 | A | 8/1991 | Hatcher | | |
| 5,098,053 | A * | 3/1992 | Cotterill | A47B 21/0314 | 108/6 |
| 5,211,367 | A | 5/1993 | Musculus | | |
| D337,907 | S | 8/1993 | Page | | |
| 5,273,250 | A | 12/1993 | Pemberton et al. | | |
| 5,292,097 | A * | 3/1994 | Russell | A47B 21/0314 | 248/281.11 |
| 5,294,087 | A | 3/1994 | Drabczyk et al. | | |
| 5,447,146 | A * | 9/1995 | Nickerson | F24C 15/16 | 126/339 |
| D364,290 | S | 11/1995 | Watts | | |
| 5,513,824 | A | 5/1996 | Leavitt et al. | | |
| 5,533,820 | A | 7/1996 | Ambrose | | |
| 5,653,413 | A | 8/1997 | Fink | | |
| 5,661,605 | A | 8/1997 | Conway | | |
| 5,707,034 | A * | 1/1998 | Cotterill | A47B 21/0314 | 312/282 |
| 5,720,230 | A | 2/1998 | Mansfield | | |
| 5,771,814 | A | 6/1998 | Clausen | | |
| 5,836,562 | A | 11/1998 | Danzyger et al. | | |
| 5,961,231 | A | 10/1999 | Ambrose | | |
| 6,079,676 | A | 6/2000 | Hackett et al. | | |
| 6,092,774 | A | 7/2000 | Choy | | |
| 6,109,571 | A | 8/2000 | Hirschovits et al. | | |
| 6,116,557 | A | 9/2000 | Choy et al. | | |
| 6,135,404 | A * | 10/2000 | Wisniewski | A47B 21/0314 | 248/281.11 |
| 6,206,464 | B1 | 3/2001 | Santa Rosa et al. | | |
| 6,273,382 | B1 | 8/2001 | Pemberton | | |
| 6,419,197 | B2 | 7/2002 | Kochanski et al. | | |
| 6,454,369 | B1 | 9/2002 | Cooper et al. | | |
| 6,874,736 | B1 | 4/2005 | Jones et al. | | |
| 7,121,516 | B1 | 10/2006 | Koh | | |
| 7,335,119 | B2 * | 2/2008 | White | A63B 63/083 | 473/483 |
| 7,516,923 | B2 | 4/2009 | Rossini | | |
| 7,654,208 | B2 * | 2/2010 | Patten | A47B 46/005 | 108/138 |
| 7,673,839 | B2 * | 3/2010 | Zhang | F16M 11/10 | 248/281.11 |
| 7,946,551 | B1 | 5/2011 | Cvek | | |
| 8,061,668 | B1 | 11/2011 | Cvek | | |
| 8,740,166 | B2 | 6/2014 | Hamilton et al. | | |
| D840,182 | S | 2/2019 | Warden et al. | | |
| D861,403 | S | 10/2019 | Hurford | | |
| 10,610,010 | B2 * | 4/2020 | Matlin | F16M 11/2014 | |
| 10,798,844 | B2 | 10/2020 | Lee et al. | | |
| 10,820,692 | B2 * | 11/2020 | Ho | A47B 88/919 | |
| D916,517 | S | 4/2021 | Lozada | | |
| D928,795 | S | 8/2021 | Zhang | | |
| 2002/0017594 | A1 | 2/2002 | DiOrio, Jr. | | |
| 2002/0195907 | A1 | 12/2002 | Lawson et al. | | |
| 2003/0042380 | A1 | 3/2003 | Hagglund et al. | | |
| 2003/0084828 | A1 | 5/2003 | Gillis | | |
| 2005/0103960 | A1 | 5/2005 | Kirchhoff | | |
| 2005/0285004 | A1 | 12/2005 | Elgie et al. | | |
| 2007/0001077 | A1 | 1/2007 | Kirchhoff | | |
| 2008/0173777 | A1 * | 7/2008 | Yamamoto | A47B 21/0314 | 248/274.1 |
| 2013/0340655 | A1 * | 12/2013 | Flaherty | A47B 9/18 | 108/106 |
| 2016/0040739 | A1 | 2/2016 | Smith et al. | | |
| 2017/0295924 | A1 | 10/2017 | Getz | | |
| 2020/0107634 | A1 | 4/2020 | Hendrix et al. | | |
| 2020/0187638 | A1 | 6/2020 | Ho et al. | | |
| 2022/0151375 | A1 | 5/2022 | Fehr et al. | | |
| 2024/0335031 | A1 * | 10/2024 | Meyer | A47B 21/0314 | |

FOREIGN PATENT DOCUMENTS

| | | | |
|---|---|---|---|
| CN | 208689549 | U | 4/2019 |
| CN | 209587504 | U | 11/2019 |
| JP | 3220592 | U | 3/2019 |
| WO | 0102938 | A1 | 1/2001 |
| WO | 2016040739 | A1 | 3/2016 |

OTHER PUBLICATIONS

Black Clamp-on Tilting Keyboard Tray: Instruction Manual: SKU: MOUNT-KB07T; Aug. 27, 2021; 4 pages; VIVO; Goodfield, Illinois.

Co-pending U.S. Appl. No. 18/132,364, 23 pages, filed Apr. 7, 2023.

Mount-It! MI-7143 Easy Clamp on Keyboard Tray; 2 pages, Oct. 29, 2018; accessed online at https://downloads.mount-it.com/pub/media/datasheets/datasheet_MI-7143.pdf on Apr. 8, 2023.

Universal Clamp-on Pull Out Keyboard Tray; web page: https://www.standupdeskstore.com/ergonomic-clamp-on-pull-out-keyboard-tray; 14 pages, Feb. 2, 2022; Stand up Desk Store; retrieved from Internet Archive: https://web.archive.org/web/20220202172159/https://www.standupdeskstore.com/ergonomic-clamp-on-pull-out-keyboard-tray on Apr. 7, 2023.

* cited by examiner

KEYBOARD TRAY WITH SWINGING HEIGHT ADJUSTMENT

TECHNICAL FIELD

This disclosure relates to keyboard trays for desktops.

BACKGROUND

Keyboard trays mounted below desktops free up desktop space and facilitate ergonomic positioning of keyboards for users.

BRIEF SUMMARY

In one example, an adjustable keyboard tray includes a swinging support, the swinging support including a desk mount configured to secure the adjustable keyboard tray to a desktop, a keyboard platform mount, and a linkage coupled to the desk mount with a first pivot and coupled to the keyboard platform mount with a second pivot. The adjustable keyboard tray further includes a keyboard platform attached to the keyboard platform mount, the keyboard platform being swingable relative to the desk mount via the linkage between a retracted position relative to the desk mount and an outward position relative to the desk mount.

In another example, a desktop assembly includes a desktop, and an adjustable keyboard tray. The adjustable keyboard tray includes a swinging support, the swinging support including a desk mount securing the adjustable keyboard tray to the desktop, a keyboard platform mount, and a linkage coupled to the desk mount with a first pivot and coupled to the keyboard platform mount with a second pivot. The adjustable keyboard tray further includes a keyboard platform attached to the keyboard platform mount, the keyboard platform being swingable relative to the desk mount via the linkage between a retracted position relative to the desk mount and an outward position relative to the desk mount.

DETAILED DESCRIPTION

Figure 1A:
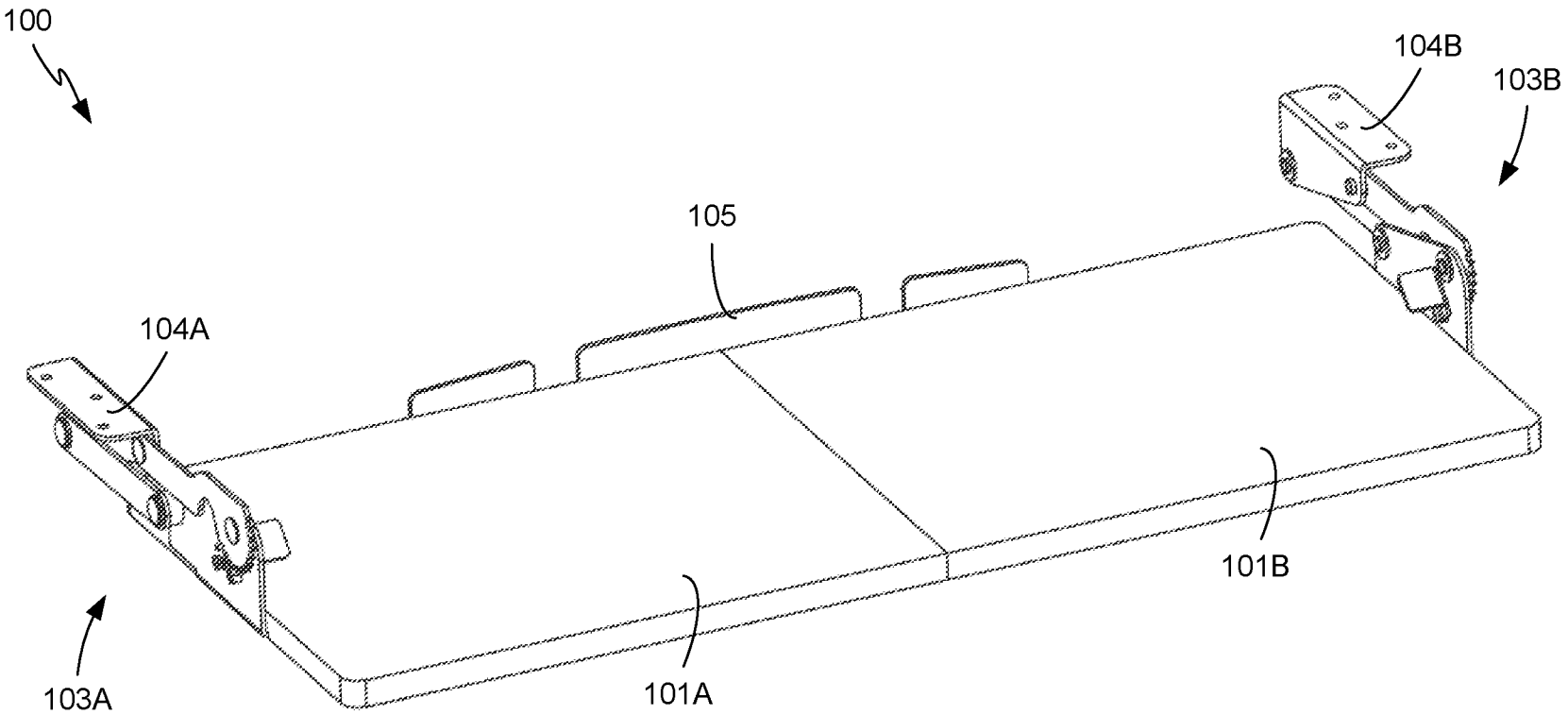
FIGS. 1A-1C illustrate an adjustable keyboard tray with a swinging support and bracket desk mounts.
Figure 1B:
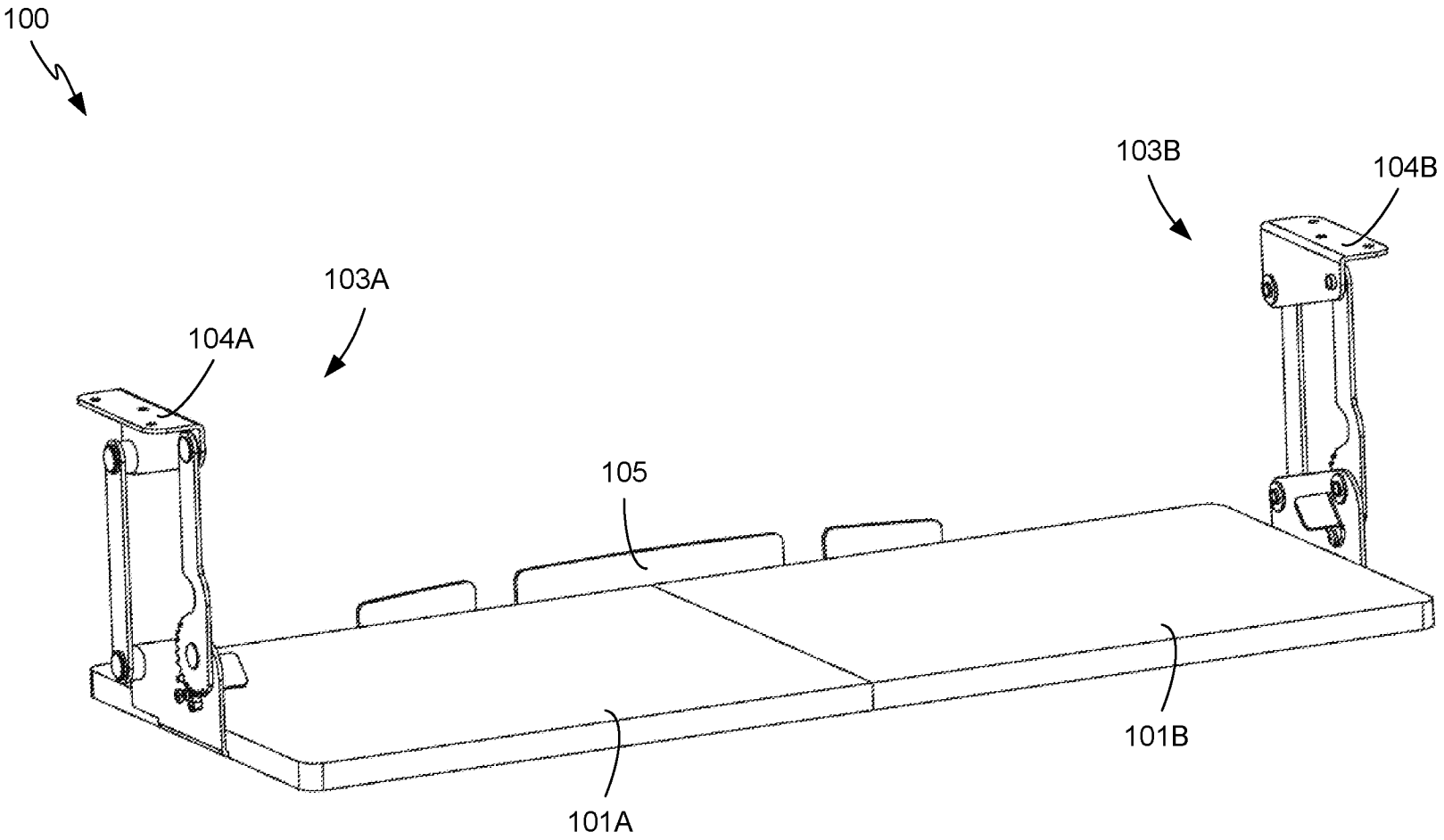
Figure 1C:
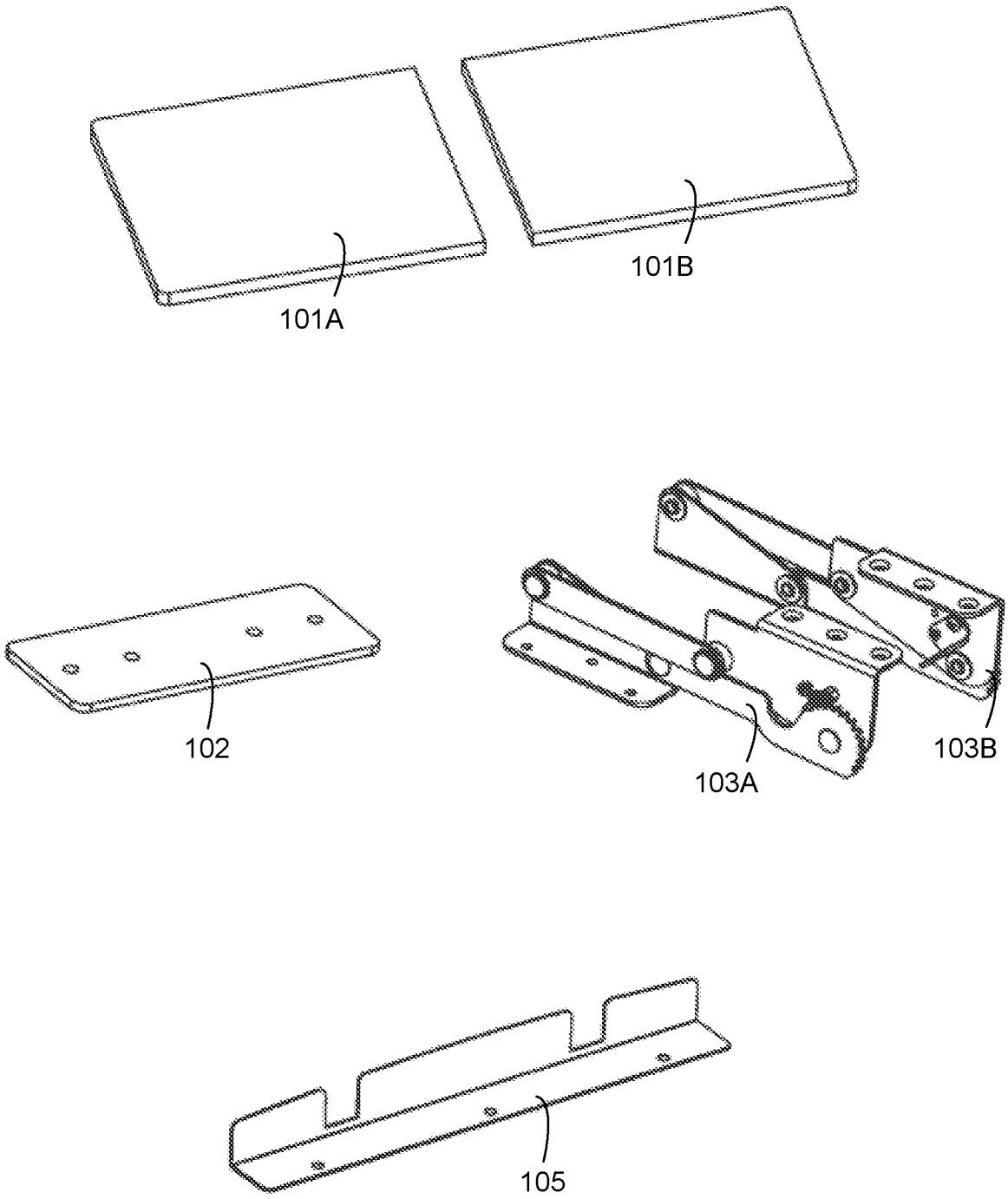

FIGS. 1A and 1B illustrate an adjustable keyboard tray 100, and FIG. 1C illustrates components of the adjustable keyboard tray 100. The adjustable keyboard tray 100 includes a keyboard platform 101 formed from keyboard platform sections 101A, 101B. The keyboard platform 101 is mounted to two swinging supports, a left swinging support 103A, and a right swinging support 103B, (collectively, "swinging supports 103"). Swinging supports 103 operate in parallel for position adjustments of the keyboard platform 101.

The swinging supports 103 include the same components, but in a reversed, mirrored orientation relative to each other. For example, the left swinging support 103A includes a left bracket 104A, and the right swinging support 103B includes a right bracket 104B. The two brackets 104A, 104B (collectively, "brackets 104"), function as desk mounts to secure the adjustable keyboard tray 100 with screws to the underside of a desktop, such as desktop 201 (FIG. 3D). Each of brackets 104 includes screw holes 106 to receive the screws that engage the underside of the desktop, thereby attaching the brackets 104 to the underside of the desktop. In some examples, the front edge of the brackets 104 may be aligned with or proximate to a front edge of the underside of the desktop.

Figure 4:
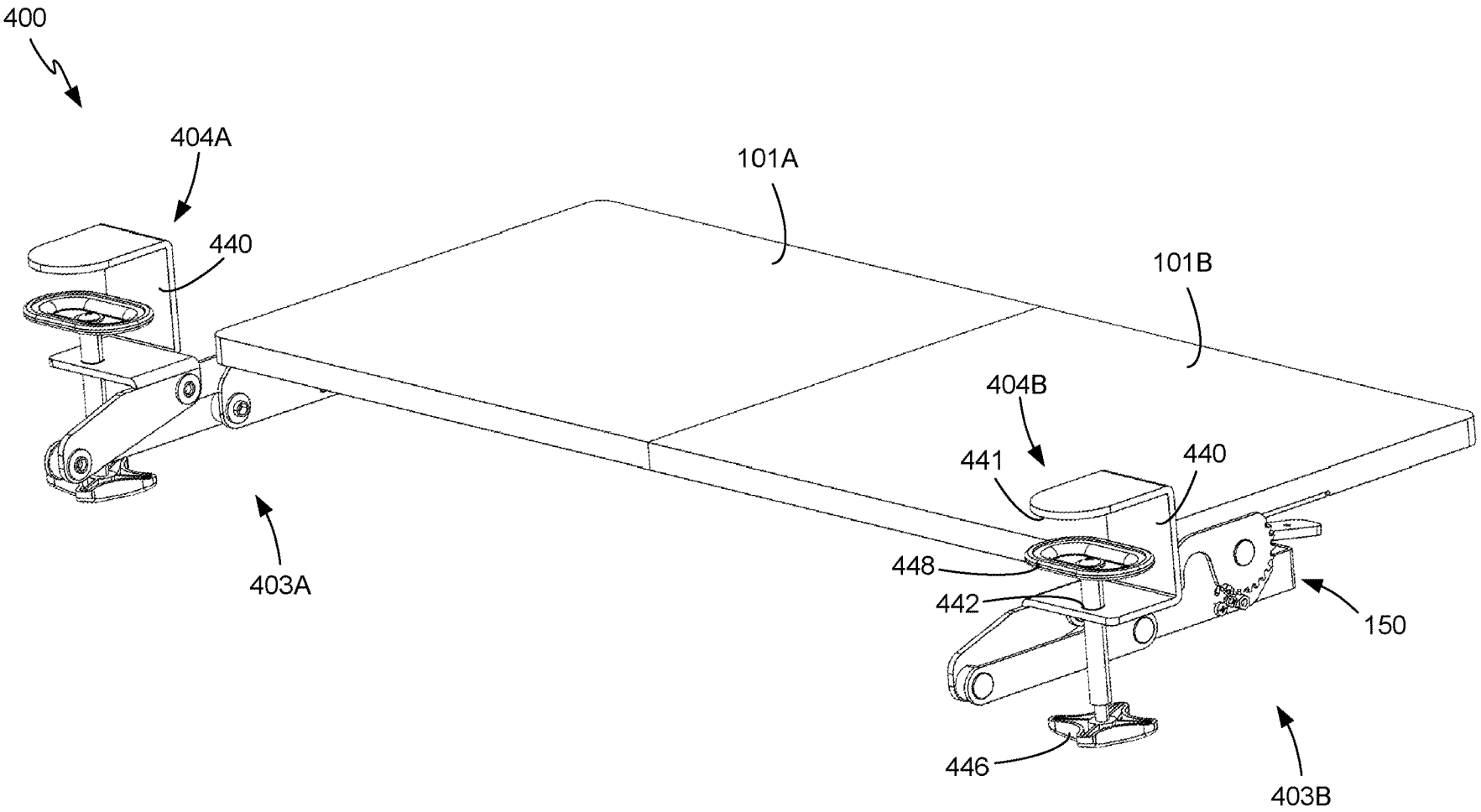
FIG. 4 illustrates an adjustable keyboard tray with swinging support and clamp desk mounts.

Alternative designs for adjustable keyboard tray 100 can include any variety of desk mounts, in addition to or instead of brackets 104. Such varieties of desk mounts include but are not limited to, clamps 404 as described with respect to adjustable keyboard tray 400 (FIG. 4).

Figure 2A:
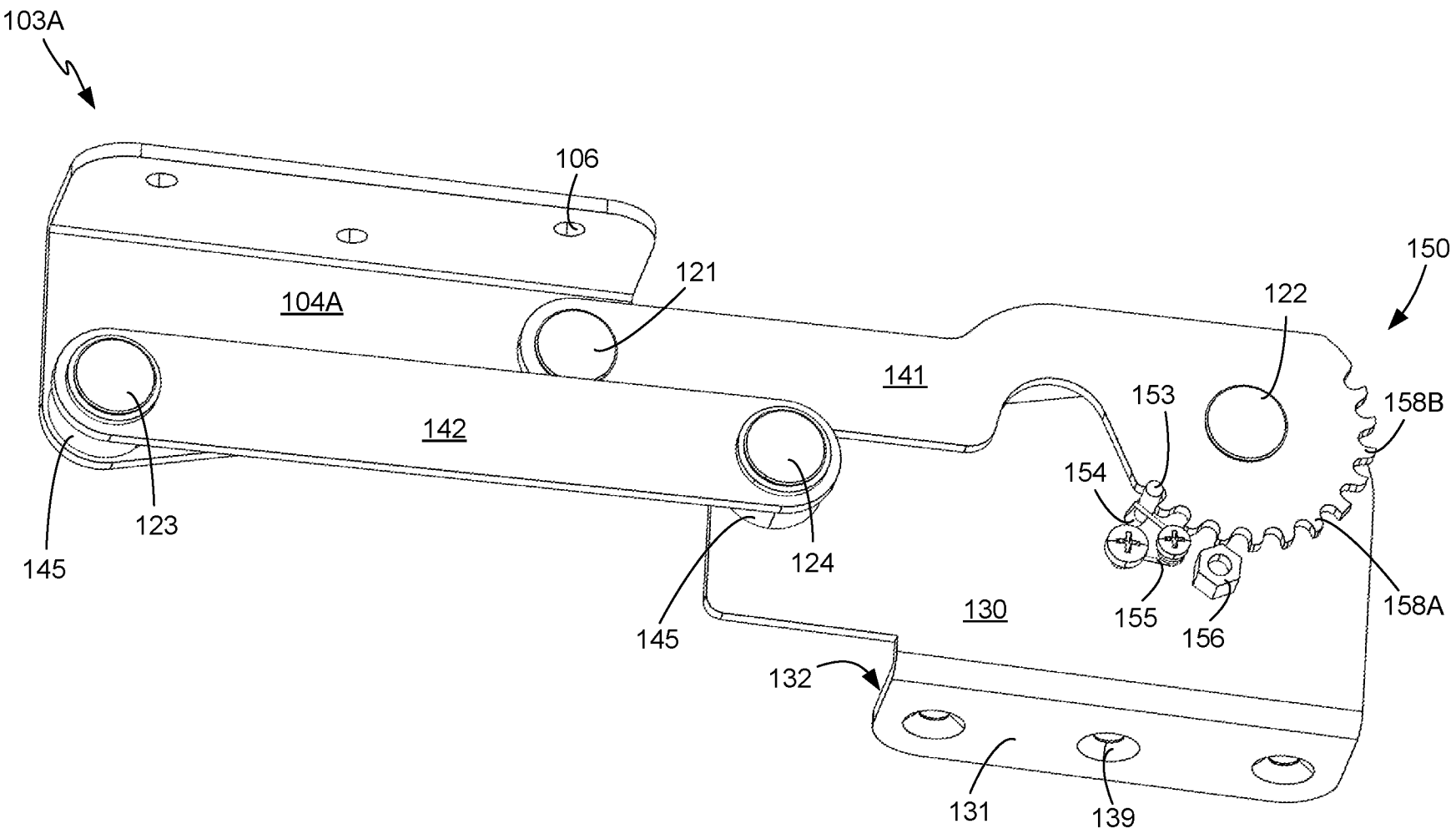
FIGS. 2A-2B illustrate a swinging support for an adjustable keyboard tray with bracket desk mounts.

The keyboard platform 101 is swingable between a retracted position relative to the brackets 104 and an outward position relative to the brackets 104 via the linkages 141, 142 (FIG. 2A). The keyboard platform 101 is attached to both keyboard platform mount 130 and spans the left swinging support 103A, and the right swinging support 103B with the swinging supports 103 operating in parallel during adjustments of the keyboard platform 101 between a retracted position and an outward position.

The keyboard platform 101 is sized to support a keyboard. Some examples of the keyboard platform 101 may be sized to support a keyboard and a computer mouse. For example, an upper surface of the keyboard platform 101 may have a width of 14 to 36 inches and a depth of 5 to 16 inches. The keyboard platform 101 includes a keyboard stop 105 extending upwards proximate the rear edge of the keyboard platform 101. The keyboard stop 105 is configured to prevent a keyboard from sliding off the back of the upper surface of the keyboard platform 101. The keyboard stop 105 includes two slits which may constrain wires for a keyboard, computer mouse, or other equipment placed on the upper surface of the keyboard platform 101.

In some examples, keyboard platform 101 may be primarily formed from a wood product. For example, the wood product may include natural wood, plywood, and/or a fiberboard comprising wood particles and a binding agent. Such fiberboards include medium density fiberboard (MDF). Some of such examples may include a laminate over at least a portion of the wood product, such as a laminate forming the upper platform surface.

As compared to other design incorporating primarily plastic materials, the wood product may provide increased rigidity as well as facilitate unique shapes. For example, while plastic components must have tapered side surfaces to allow removal from a mold, surfaces of keyboard platform sections 101A, 101B may form right angles relative to each other and an ergonomically tapered front edge. In another variation, all or portions of the side surfaces of keyboard platform sections 101A, 101B may include a rounded, convex, surface formed by edge banding between the upper surfaces and the undersides. The edge banding covers and seals the side surfaces of the base material, providing protection and improving the appearance of the product.

Other examples of adjustable keyboard tray 100 may include different swinging configurations, including a single swinging arm mount. In such an example, one locking mechanism may set the position of a pivot between the swinging linkage and the keyboard platform mount 130.

In some examples, adjustable keyboard tray 100 may be sold as a kit without a separate desktop. Separate components in an example kit for adjustable keyboard tray 100 are shown in FIG. 1C. These components include:

Keyboard platform sections 101A, 101B (1 each)

Connecting plate 102 (×2)

Swinging supports 103A, 103B (1 each)

Keyboard stop 105 (×1)

The keyboard platform 101 includes two keyboard platform 101 sections 101A, 101B joined with connecting plates 102 that span a joint between the two keyboard platform 101 sections 101A, 101B along an underside of the keyboard platform 101. Other examples may include a unitary keyboard platform 101, rather than two keyboard platform sections 101A, 101B. The use of keyboard platform sections 101A, 101B facilitates a reduced overall package dimensions for the kit for adjustable keyboard tray 100 prior to final assembly by a customer. In some examples, a packaging size with a maximum box length of 18 inches may reduce shipping expenses compared to designs requiring larger packaging.

Figure 2B:
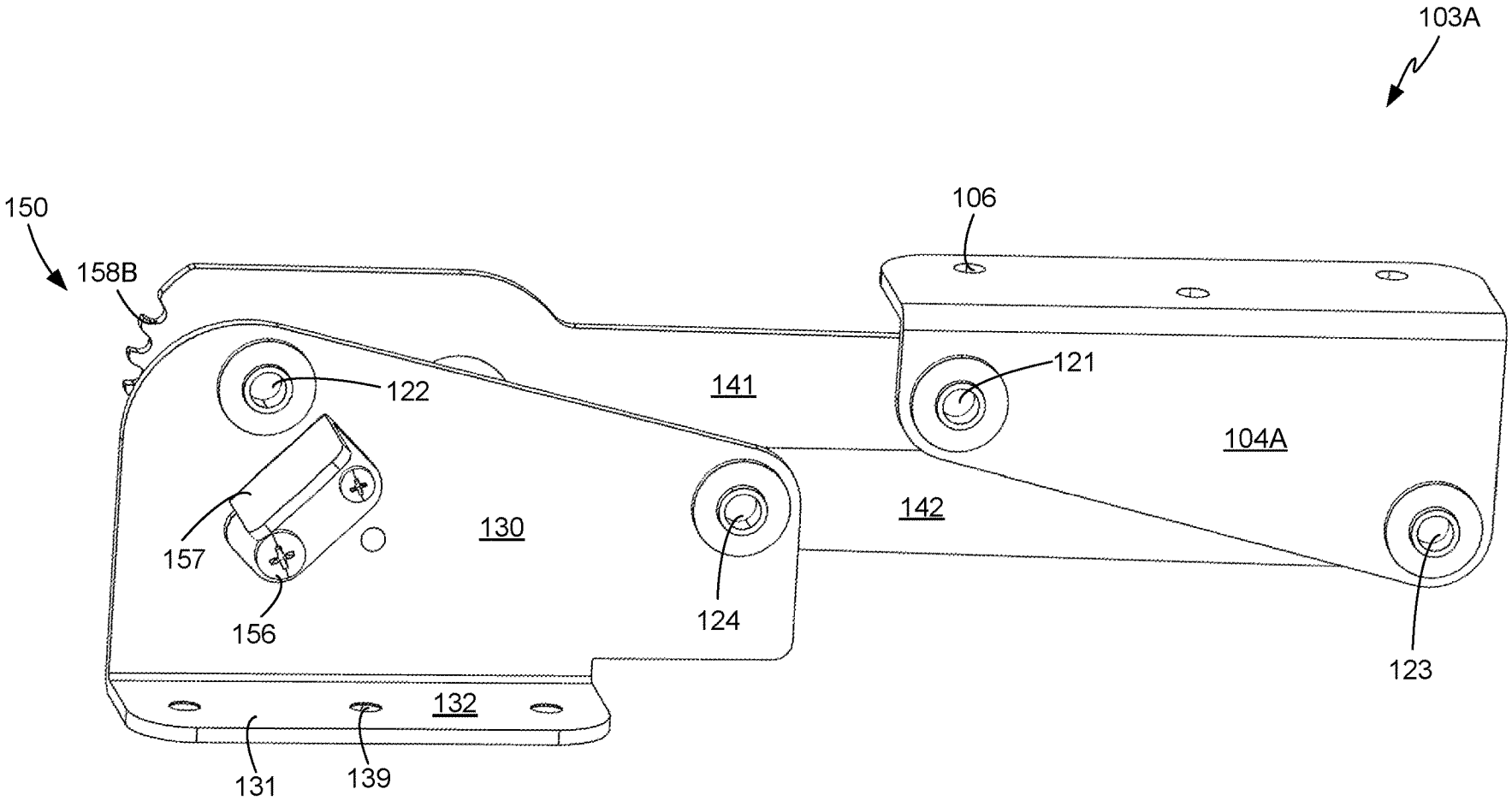

FIGS. 2A and 2B illustrate the left swinging support 103A of adjustable keyboard tray 100. The left swinging support 103A is representative of the left swinging support 103A of adjustable keyboard tray 100, except the components of the left swinging support 103A of adjustable keyboard tray 100 are mirrored. For brevity, the left swinging support 103A is not described separately.

Each swinging support 103 includes a linkage 141 coupled to its bracket 104 with a first pivot 121 and coupled to the keyboard platform mount 130 with a second pivot 122. The keyboard platform mount 130 includes mounting tabs 131 with an upper mounting surface 132 and screw holes 139 for attaching the keyboard platform 101 to the keyboard platform mount 130 in contact with the upper mounting surface 132.

Each swinging support 103 further includes a second linkage 142 coupled to the brackets 104 with a third pivot 123 and coupled to the keyboard platform mount 130 with a fourth pivot 124. The brackets 104, the first linkage 141, the keyboard platform mount 130, the second linkage 142, the first pivot 121, the second pivot 122, the third pivot 123, and the fourth pivot 124 combine to form a four-bar linkage that facilitates the swingable motion of the keyboard platform 101 relative to the brackets 104. The four-bar linkage allows keyboard platform 101 to remain about parallel to a desktop mounting surface of the brackets 104 between the retracted position relative to the brackets 104 and the outward position relative to the brackets 104. Spacers 145 offset the second linkage 142 relative to the first linkage such to prevent interference of the linkages 141, 142 through the range of motion of the swinging support 103. Pivots 121, 122, 123, 124 may be formed from any rotational mechanism, such as an axle mechanism or rolling element bearing mechanism. In various examples, the axle may be formed by a bar, pin, bolt, rivet or by other means. In some examples the axle is fixed to one bar of the pivot while the other rotates about the axle.

Each swinging support 103 further includes a position lock 150 to fix a position setting of the linkage and keyboard platform mount 130 relative to the brackets 104. The position lock 150 includes a locking pin 153 configured to selectively engage any of a series of radially oriented teeth 158A, 158B (collectively teeth 158). The series of radially oriented teeth 158 are arranged about the second pivot 122 and include a first set of teeth 158A oriented to engage the pin with the keyboard platform 101 in outward positions (as shown in FIG. 2A) relative to the brackets 104 and a second set of teeth 158B oriented to engage the pin with the keyboard platform 101 in retracted positions relative to the brackets 104. The opposite orientations of the teeth 158A and 158B are configured to counteract the gravity at different positions about the range of motion of the keyboard platform 101.

The locking pin 153 extends through a slot 154 in the bracket 104. The position lock 150 further includes a spring 155 to bias the locking pin 153 to selectively engage one of the series of radially oriented teeth 158. A manual release 157 allows a user to disengage the position lock 150 by overcoming the spring bias to pivot the manual release about pivot 156. In the particular example of position lock 150, manual release 157 is a thumb tab. The manual release 157 pivots about release pivot 156 (a screw) in the keyboard platform mount 130. The locking pin 153 is fixed to manual release 157 and extends through slot 154 to selectively engage one of the radially oriented teeth 158 on the opposing side of the keyboard platform mount 130.

With the locking pin 153 disengaged from the radially oriented teeth 158, a user is free to adjust the position setting of the linkage and keyboard platform mount 130 relative to the brackets 104. Specifically, the user may adjust the position of the keyboard tray 101 by swinging the keyboard tray platform 101 to a desired position within the range of motion of the four-bar linkage.

Figure 3A:
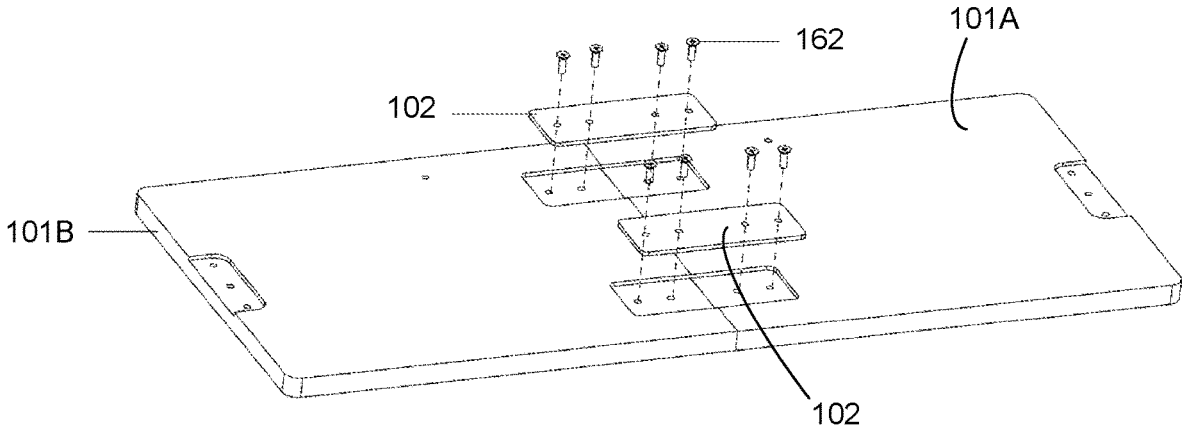
FIGS. 3A-3D illustrate steps for mounting an adjustable keyboard tray with swinging support and bracket desk mounts to a desktop.
Figure 3B:
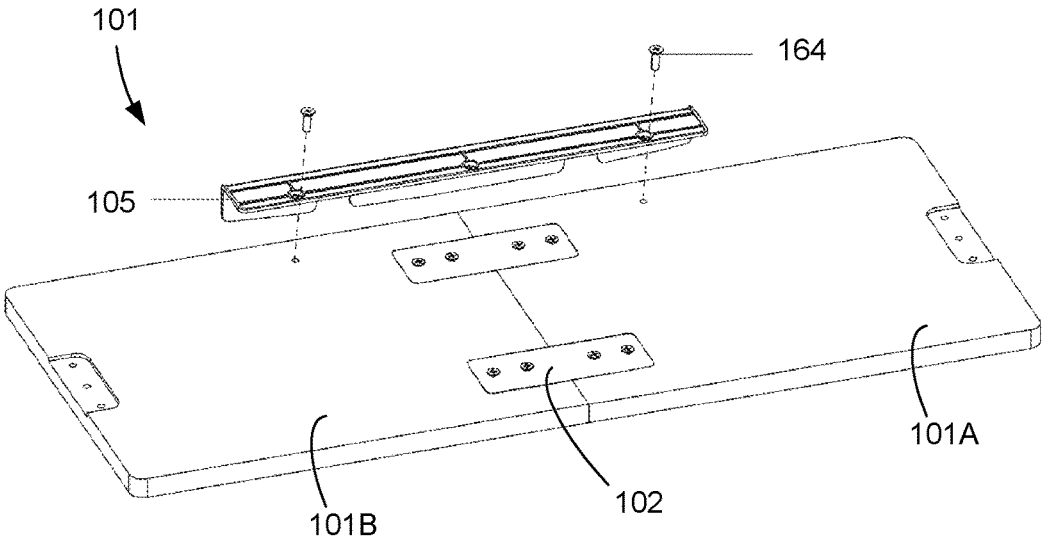
Figure 3C:
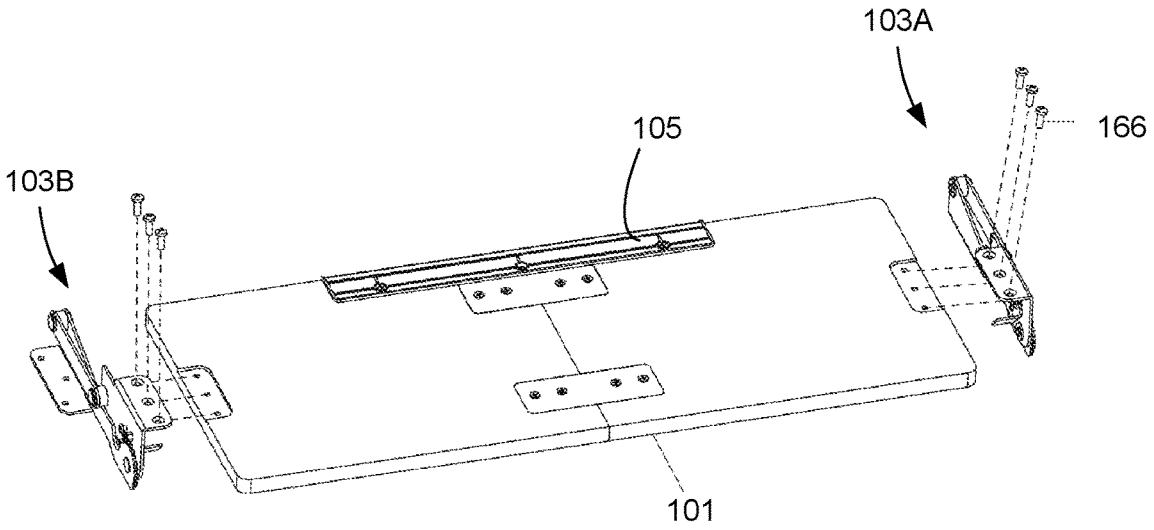
Figure 3D:
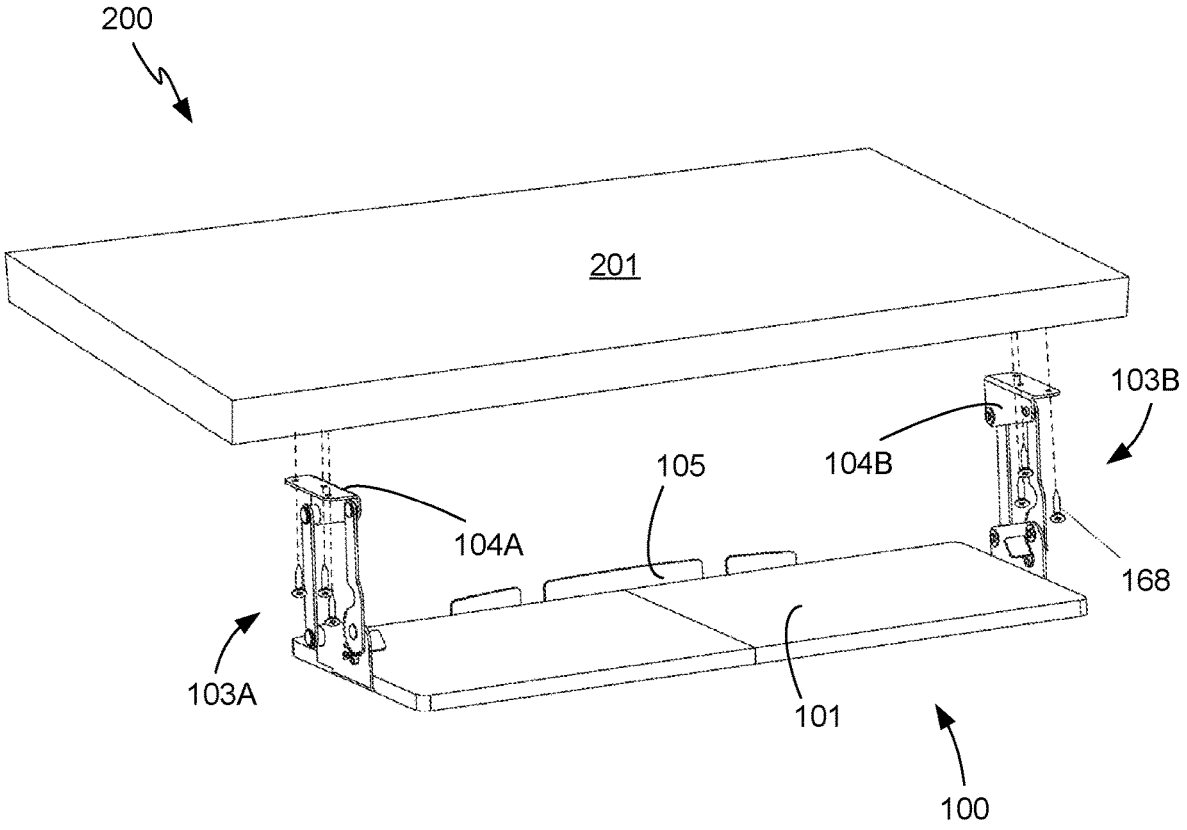

FIGS. 3A-3D illustrate steps for assembling adjustable keyboard tray 100 and a desktop 201 to form a desktop assembly 200. Specifically, FIGS. 3A-3C illustrate steps for assembling adjustable keyboard tray 100, and FIG. 3D illustrates the step of attaching the adjustable keyboard tray 100 to desktop 201 to form a desktop assembly 200. The description of FIGS. 3A-3D includes example details, such as screws; however, any suitable fixation mechanisms may be used, and the techniques of this disclosure may be adapted for any desired dimensions.

FIG. 3A illustrates joining keyboard platform sections 101A, 101B with connecting plates 102 using screws 162. FIG. 3B illustrates attaching keyboard stop 105 to keyboard platform 101 with screws 164. FIG. 3C illustrates attaching left swinging support 103A and right swinging support 103B to keyboard platform 101 with screws 166 through holes 139 in mounting tabs 131 of keyboard platform mount 130. Keyboard platform sections 101A, 101B include recesses sized to flush mount connecting plates 102 and optional predrilled holes for screws 162. Likewise, keyboard platform sections 101A, 101B include recesses sized to flush mount keyboard platform mount 130 and optional predrilled holes for screws 164, 166.

FIG. 3D illustrates steps for attaching adjustable keyboard tray 100 to desktop 201 to form desktop assembly 200. As shown in FIG. 3D, a user attaches swinging supports 103 to the underside of desktop 201 using screws 168. Screws 168 extend through holes 106 in brackets 104 of each swinging support 103 and engage predrilled holes in the underside of desktop 201.

The swinging adjustment provided by adjustable keyboard tray 100 allows users to set keyboard platform 101 at a preferred ergonomic position about the range of motion of swinging supports 103 for their individual preferences and workspace.

FIG. 4 illustrates an adjustable keyboard tray 400. Adjustable keyboard tray 400 includes a keyboard platform 101 formed from keyboard platform sections 101A, 101B. The keyboard platform 101 is mounted to two swinging supports, a left swinging support 403A, and a right swinging support 403B, (collectively, "swinging supports 403").

Swinging supports 403 operate in parallel for position adjustments of the keyboard platform 101.

Adjustable keyboard tray 400 is substantially similar to adjustable keyboard tray 100 except that two clamps 404A, 404B (collectively, "clamps 404") replace brackets 104. For brevity, details regarding the adjustable keyboard tray 100 are not repeated with respect to the adjustable keyboard tray 400. Each clamp 404 replaces the bracket 104 of adjustable keyboard tray 100 in the four bar linkage of the swinging supports 403 in that each clamp 404 attaches to the desktop and includes two pivots for the four bar linkage as well as a position lock 150 including the series of radially oriented teeth. In this manner, the swinging supports 403 operate in a substantially similar manner to swinging supports 103.

The two clamps 404 function as desk mounts to secure the adjustable keyboard tray 100 by engaging an edge of a desktop, such as desktop 201 (FIG. 3D). Each clamp 404 includes a C-shaped clamp bracket 440 with an upper clamping surface 441 and a threaded aperture 442 on the opposing side of the C-shaped clamp bracket 440. Optional clamp pads may be positioned over upper clamping surface 441 of the clamp brackets 440 to protect a topside of a desktop from the clamps 404. The hand screw 446 includes a threaded shaft engaged with the threaded aperture 442 and a pivoting clamp foot 448 with a lower clamping surface of the clamp 404. A user turns the hand screw 446 to tighten and loosen each clamp 404.

The assembly process includes securing adjustable keyboard tray 400 to the desktop 201 with clamps 404. Specifically, a user positions the clamps 404 over the edge of the desktop 201 and turns the hand screws 446 to tighten the clamps 404 to engage the edge of the desktop 201. With adjustable keyboard tray 100 secured to the desktop 201, adjustable keyboard tray 400 operates in the same manner as adjustable keyboard tray 100, swinging between retracted positions and outward positions relative to the clamps 404 and the desktop.

The specific techniques for adjustable keyboard trays, including techniques described with respect to adjustable keyboard trays 100, 400 and desktop assembly 200, are merely illustrative of the general inventive concepts included in this disclosure as defined by the following claims.

What is claimed is:

1. An adjustable keyboard tray comprising:

a swinging support, the swinging support including:

a desk mount configured to secure the adjustable keyboard tray to a desktop;

a keyboard platform mount; and a linkage coupled to the desk mount with a first pivot and coupled to the keyboard platform mount with a second pivot;

a keyboard platform attached to the keyboard platform mount, the keyboard platform being swingable relative to the desk mount via the linkage between a retracted position relative to the desk mount and an outward position relative to the desk mount; and a position lock to fix a position setting of the linkage and keyboard platform mount relative to the desk mount, wherein the position lock includes an actuatable locking member configured to selectively engage any of a series of radially oriented teeth arranged about one of the pivots of the swinging support, wherein the series of radially oriented teeth include a first set of teeth with a clockwise inclination and a second set of teeth with a counterclockwise inclination.

2. The adjustable keyboard tray of claim 1, wherein the keyboard platform remains about parallel to a desktop mounting surface of the desk mount between the retracted position relative to the desk mount and the outward position relative to the desk mount.

3. The adjustable keyboard tray of claim 1, wherein the swinging support further includes a second linkage coupled to the desk mount with a third pivot and coupled to the keyboard platform mount with a fourth pivot, wherein the desk mount, the first linkage, the keyboard platform mount, the second linkage, the first pivot, the second pivot, the third pivot and the fourth pivot combine to form a four-bar linkage that facilitates the swingable motion of the keyboard platform relative to the desk mount.

4. The adjustable keyboard tray of claim 1, wherein the first set of teeth are oriented to engage the member with the keyboard platform in outward positions relative to the desk mount and the second set of teeth are oriented to engage the member with the keyboard platform in retracted positions relative to the desk mount.

5. The adjustable keyboard tray of claim 1, wherein the position lock further includes a spring to bias the locking member to selectively engage the series of radially oriented teeth.

6. The adjustable keyboard tray of claim 1, further comprising a manual release allowing a user to disengage the position lock and adjust the position setting of the linkage and keyboard platform mount relative to the desk mount.

7. The adjustable keyboard tray of claim 6, further comprising a clamp pad over a clamping surface of the clamp to protect a topside of the desktop from the clamp.

8. The adjustable keyboard tray of claim 1, wherein the swinging support is a first swinging support, the adjustable keyboard tray further comprising a second swinging support with the keyboard platform attached to the second swinging support such that the keyboard platform spans the first swinging support and the second swinging support, wherein the second swinging support operates in parallel with the first swinging support during adjustments of the keyboard platform between the retracted position and the outward position.

9. The adjustable keyboard tray of claim 1, wherein the desk mount includes a bracket with screw holes configured for attachment to an underside of the desktop.

10. The adjustable keyboard tray of claim 1, wherein the desk mount includes a clamp configured to engage an edge of the desktop.

11. The adjustable keyboard tray of claim 1, further comprising a keyboard stop extending upwards proximate a rear edge of the keyboard platform.

12. The adjustable keyboard tray of claim 1, wherein the keyboard platform includes two keyboard platform sections joined with connecting plates that span a joint between the two keyboard platform sections along an underside of the keyboard platform.

13. The adjustable keyboard tray of claim 1, wherein the actuatable locking member extends through a slot in the swinging support.

14. The adjustable keyboard tray of claim 1, wherein the actuatable locking member extends through a slot in the keyboard platform mount.

15. The adjustable keyboard tray of claim 1, wherein the actuatable locking member includes an actuatable locking pin.

16. The adjustable keyboard tray of claim 1, wherein the opposite orientations of the first set of teeth and the second set of teeth are configured to counteract the gravity at different positions about the range of motion of the keyboard platform.

17. An adjustable keyboard tray comprising:

a swinging support, the swinging support including:

a desk mount configured to secure the adjustable keyboard tray to a desktop;

a keyboard platform mount; and a linkage coupled to the desk mount with a first pivot and coupled to the keyboard platform mount with a second pivot;

a keyboard platform attached to the keyboard platform mount, the keyboard platform being swingable relative to the desk mount via the linkage between a retracted position relative to the desk mount and an outward position relative to the desk mount; and a position lock to fix a position setting of the linkage and keyboard platform mount relative to the desk mount, wherein the position lock includes a locking pin configured to selectively engage any of a series of radially oriented teeth, and wherein the locking pin extends through a slot in the desk mount and the series of radially oriented teeth are arranged about the second pivot.

18. A desktop assembly comprising:

a desktop; and an adjustable keyboard tray, the adjustable keyboard tray including:

a swinging support, the swinging support including:

a desk mount securing the adjustable keyboard tray to the desktop;

a keyboard platform mount; and a linkage coupled to the desk mount with a first pivot and coupled to the keyboard platform mount with a second pivot;

a keyboard platform attached to the keyboard platform mount, the keyboard platform being swingable relative to the desk mount via the linkage between a retracted position relative to the desk mount and an outward position relative to the desk mount; and a position lock to fix a position setting of the linkage and keyboard platform mount relative to the desk mount, wherein the position lock includes an actuatable locking member configured to selectively engage any of a series of radially oriented teeth arranged about one of the pivots of the swinging support, wherein the series of radially oriented teeth include a first set of teeth with a clockwise inclination and a second set of teeth with a counterclockwise inclination.

19. The desktop assembly of claim 18, wherein the keyboard platform remains about parallel to a desktop mounting surface of the desk mount between the retracted position relative to the desk mount and the outward position relative to the desk mount.

20. The desktop assembly of claim 18, wherein the swinging support further includes a second linkage coupled to the desk mount with a third pivot and coupled to the keyboard platform mount with a fourth pivot, wherein the desk mount, the first linkage, the keyboard platform mount, the second linkage, the first pivot, the second pivot, the third pivot and the fourth pivot combine to form a four-bar linkage that facilitates the swingable motion of the keyboard platform relative to the desk mount.

21. The desktop assembly of claim 18, further comprising a manual release allowing a user to disengage the position lock and adjust the position setting of the linkage and keyboard platform mount relative to the desk mount.

22. The desktop assembly of claim 18, wherein the swinging support is a first swinging support, the adjustable keyboard tray further comprising a second swinging support with the keyboard platform attached to the second swinging support such that the keyboard platform spans the first swinging support and the second swinging support, wherein the second swinging support operates in parallel with the first swinging support during adjustments of the keyboard platform between the retracted position and the outward position.

23. The desktop assembly of claim 18, wherein the desk mount includes a bracket with screw holes, the desktop assembly further comprising screws through the screw holes into an underside of the desktop, thereby attaching the bracket to the underside of the desktop.

24. The desktop assembly of claim 18, wherein the desk mount includes a clamp engaging an edge of the desktop.

25. The desktop assembly of claim 18, wherein the actuatable locking member extends through a slot in the swinging support.

* * * * *